US009718576B2

(12) United States Patent
Moore

(10) Patent No.: US 9,718,576 B2
(45) Date of Patent: Aug. 1, 2017

(54) CONTAINER AND BLANK

(71) Applicant: COLPAC LIMITED, Flitwick, Bedfordshire (GB)

(72) Inventor: Samantha Moore, Broughton Milton Keynes (GB)

(73) Assignee: COLPAC LIMITED, Flitwick, Bedfordshire (GB)

( * ) Notice: Subject to any disclaimer, the term of this patent is extended or adjusted under 35 U.S.C. 154(b) by 0 days.

(21) Appl. No.: 14/369,691

(22) PCT Filed: Dec. 31, 2012

(86) PCT No.: PCT/GB2012/000928
§ 371 (c)(1),
(2) Date: Jun. 28, 2014

(87) PCT Pub. No.: WO2013/098544
PCT Pub. Date: Jul. 4, 2013

(65) Prior Publication Data

US 2015/0060535 A1 Mar. 5, 2015

(30) Foreign Application Priority Data

Dec. 29, 2011 (GB) ..... 1122495.3
Sep. 19, 2012 (GB) ..... 1216770.6

(51) Int. Cl.
*B65D 5/24* (2006.01)
*B65B 7/26* (2006.01)
(Continued)

(52) U.S. Cl.
CPC ..... *B65D 5/243* (2013.01); *B31B 1/26* (2013.01); *B31B 1/64* (2013.01); *B31B 1/90* (2013.01); *B65B 5/02* (2013.01); *B65B 7/26* (2013.01)

(58) Field of Classification Search
USPC ..... 493/129; 229/170, 137
See application file for complete search history.

(56) References Cited

U.S. PATENT DOCUMENTS 2,430,610 A 11/1947 Guyer
2,912,153 A * 11/1959 Lange ..... 229/137
(Continued)

FOREIGN PATENT DOCUMENTS

DE 1269941 B 6/1968
FR 1448483 A 8/1966
(Continued)

OTHER PUBLICATIONS

Office Action issued Dec. 4, 2014 for U.S. Appl. No. 13/994,604, 16 pages.

(Continued)

*Primary Examiner* — Christopher Demeree
(74) *Attorney, Agent, or Firm* — Smith IP Services, P.C.

(57) ABSTRACT

The invention relates to a container. In particular the invention relates to a container for receiving a food product which container is formed from a folded blank. The body of the container is formed from panels of the container blank and at least one flange section is provided at an edge of an opening of the container body. The flange section comprises two overlapping flange panels of the container blank, which are bonded together to maintain the shape of the container body.

14 Claims, 11 Drawing Sheets

(51) Int. Cl.

| | |
|---|---|
| ***B31B 1/90*** | (2006.01) |
| ***B65B 5/02*** | (2006.01) |
| ***B31B 1/26*** | (2006.01) |
| ***B31B 1/64*** | (2006.01) |

(56) References Cited

U.S. PATENT DOCUMENTS

| | | | | | |
|---|---|---|---|---|---|
| 3,618,481 | A | | 11/1971 | Odenhagen | |
| 4,304,352 | A | * | 12/1981 | Humphries | B65D 5/246 229/125.35 |
| 4,657,177 | A | | 4/1987 | Karabedian | |
| 4,871,071 | A | * | 10/1989 | Zimmermann | 229/120 |
| 4,930,639 | A | * | 6/1990 | Rigby | 229/208 |
| 4,951,868 | A | * | 8/1990 | Mode | 229/112 |
| 5,253,801 | A | | 10/1993 | Bernstein et al. | |
| 6,431,365 | B1 | | 8/2002 | Money | |
| 7,143,930 | B2 | | 12/2006 | Money et al. | |
| 2010/0019020 | A1 | | 1/2010 | Phung et al. | |
| 2010/0127054 | A1 | | 5/2010 | Goldman et al. | |
| 2010/0155279 | A1 | | 6/2010 | Wood | |
| 2014/0027501 | A1 | | 1/2014 | Mills et al. | |

FOREIGN PATENT DOCUMENTS

| | | | |
|---|---|---|---|
| GB | 1500304 | A | 2/1978 |
| GB | 2425524 | A | 11/2006 |
| GB | 2428234 | A | 1/2007 |
| GB | 2433064 | A | 6/2007 |
| GB | 2457943 | A | 9/2009 |
| GB | 2468193 | A | 9/2010 |
| GB | 2479703 | A | 10/2011 |
| WO | 9002690 | A1 | 5/1990 |
| WO | 2005051780 | A1 | 6/2005 |
| WO | 2012080708 | A1 | 6/2012 |
| WO | 2013098544 | A1 | 7/2013 |

OTHER PUBLICATIONS

International Search Report issued Apr. 24, 2013 for PCT Patent Application No. PCT/GB2012/000928, 3 pages.
Office Action issued Jul. 20, 2015 for U.S. Appl. No. 13/994,604, 6 pages.
Office Action issued Dec. 22, 2015 for U.S. Appl. No. 13/994,604, 10 pages.
Office Action issued Mar. 14, 2016 for U.S. Appl. No. 13/994,604, 8 pages.

* cited by examiner

CONTAINER AND BLANK

CROSS-REFERENCE TO RELATED APPLICATIONS

This application is a national stage under 35 USC §371 of international application serial no. PCT/GB2012/000928 filed on 31 Dec. 2012, which claims priority to United Kingdom application serial nos. 1122495.3 and 1216770.6 filed on 29 Dec. 2011 and 19 Sep. 2012, respectively. The entire disclosures of these prior applications are incorporated herein by this reference.

The invention relates to a container, and particularly, but not exclusively to a hermetically sealable container for receiving a food product. The invention also relates to a blank for such a container and to a method for forming such a container.

It is known to provide food packaging in the form of containers which can be formed in two stages. In the first stage, the container is taken from its initial state, generally as a flat container blank, and part formed by folding and bonding various parts of the blank together while leaving the part formed container in a flat configuration for shipping. In the second stage, the part formed container is 'popped up' and further formed to provide a finished container. Generally, the second stage of forming the container requires that the walls of the part formed flat container are first erected, and then that further panels of the container are bonded together to provide a robust three dimensional container ready for filling. After the container has been filled a lid is then sealed to the container to provide the finished product.

The process of bonding panels of an erected container together can be complex and time consuming, and often requires specialist tools. For this reason, it remains common for containers to be fully formed before being dispatched to customers, despite the significant cost implications this has.

If the second forming stage could be simplified, then part formed containers would become a practical option for more manufacturers. This would in turn reduce the cost and environmental impact of delivering containers to a customer, because the flat folded packs take up considerably less space than fully formed containers.

The present invention provides a container according to the appended claim 1.

Further advantageous features are recited in the associated dependent claims.

By relying on the bonding together of overlapping flange panels around an opening of the container to support the container walls and maintain the shape of the container body, the need to bond other parts of the container together is avoided.

The overlapping flange panels may be bonded together by heat sealing, possibly when a lid is applied to the flange to close the container. In this case it is of assistance if a layer of heat sealable film is provided between the two overlapping flange panels.

The container preferably comprises a lid with one or more lines of weakness to create a frangible opening for the container. Preferably, the lines of weakness are arranged such that portions of the lid remain bonded to the container flanges to help keep the overlapping flange panels bonded together and provide additional strength to the container once opened.

The blank for forming the container described above may comprise wall panels with webbing sections in between. A first of said overlapping flange panels can then extend from each webbing section and a second of said overlapping flange panels can extend from at least one wall panel adjacent each webbing section.

Additional areas of heat sealable film may extend from the webbing sections for sandwiching between the overlapping flange panels such that the heat sealable film bonds said overlapping flange panels together to form a flange of the finished container. The film areas may be provided between ends of said first and second overlapping flange panels, and folding of the blank may automatically cause these film areas to be sandwiched between the flange panels. The film areas may be folded into a zig-zag fold as a result of folding the blank. The ends of said first and second overlapping flange panels are cutaway to enlarge the areas of heat sealable film, and possibly to ensure that the folds created between panels of the blank can extend into areas of unsupported film.

The webbing sections may be formed in two parts with a fold line in between. The two webbing sections may be of equal size and shape or may be asymmetric.

The container may be formed by taking the blank described above and bonding a first part of each webbing section to a wall panel, possibly using glue dots, with the blank folded in a flat configuration. This provides a partially formed container which takes up minimal space for shipping, and may be easily formed into a finished container by the customer.

The subsequent steps to form the finished container may include folding a wall panel to a set angle relative to a base panel, folding the overlapping flange panels outward from the wall panel and bonding the overlapping flange panels together. The flange panels may be bonded together either before or after filling the container to maintain the container in an erect configuration. The bonding could possibly be achieved by the process of heat sealing a lid to the flange panels to close the container after filling.

The container of the present invention is advantageous in that, after the initial part forming, the only remaining bonding can be achieved by heat sealing the lid to the container body. This avoids the process step of separately bonding the container walls in an erect position. Instead, the flat, part formed, container is erected by suitable tools and then held by the tools in the erect configuration ready for filling. After filling, the lid is heat sealed onto the container. The heat sealing action also serves to bond overlapping layers of heat sealable material within the container flanges, which gives structural integrity to the container walls even when the container lid is subsequently opened or removed.

By using the lid sealing process, which would always be a step performed by a customer after filling the container, to also bond the container together, the entire second stage forming process can be achieved without the need for any additional specialist tools.

A better understanding of the present invention will be obtained from the following detailed description. The description is given by way of example only and makes reference to the accompanying drawings in which.

Figure 9:
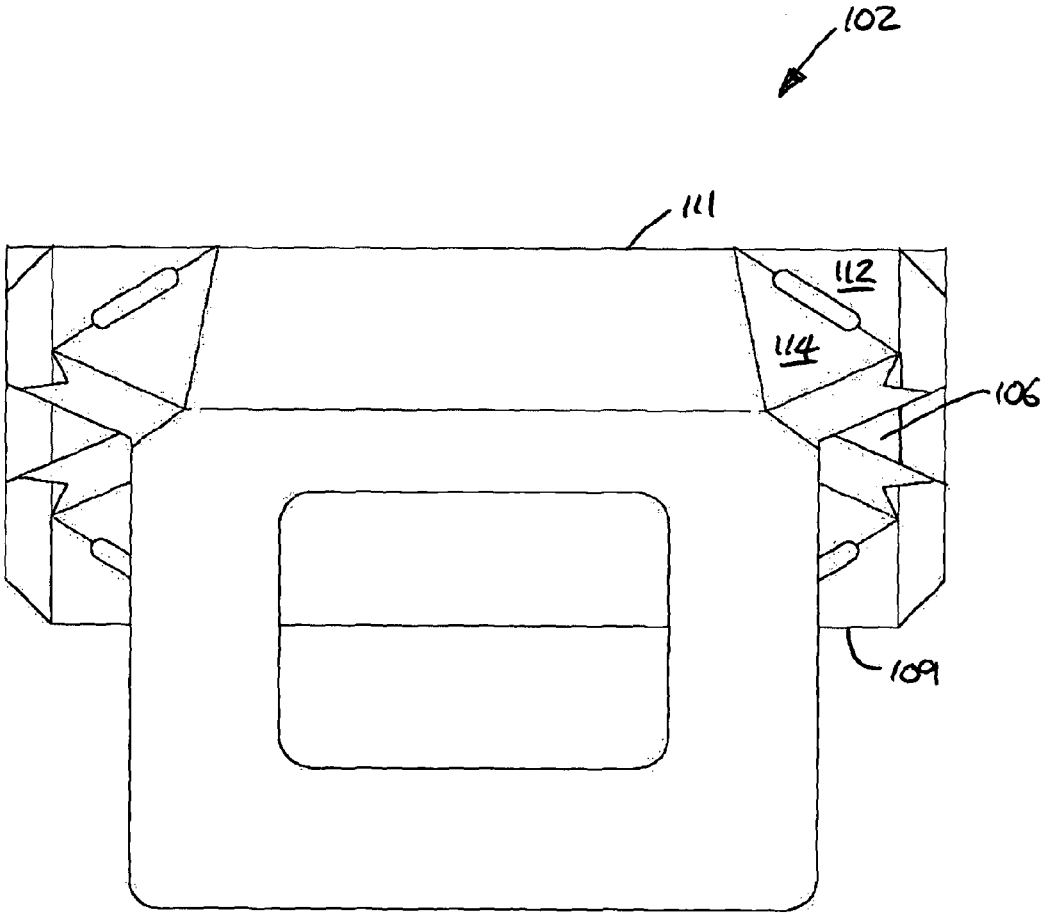
FIG. 9 is a plan view showing the blank of FIG. 8 folded into a part formed configuration.
Figure 10A:
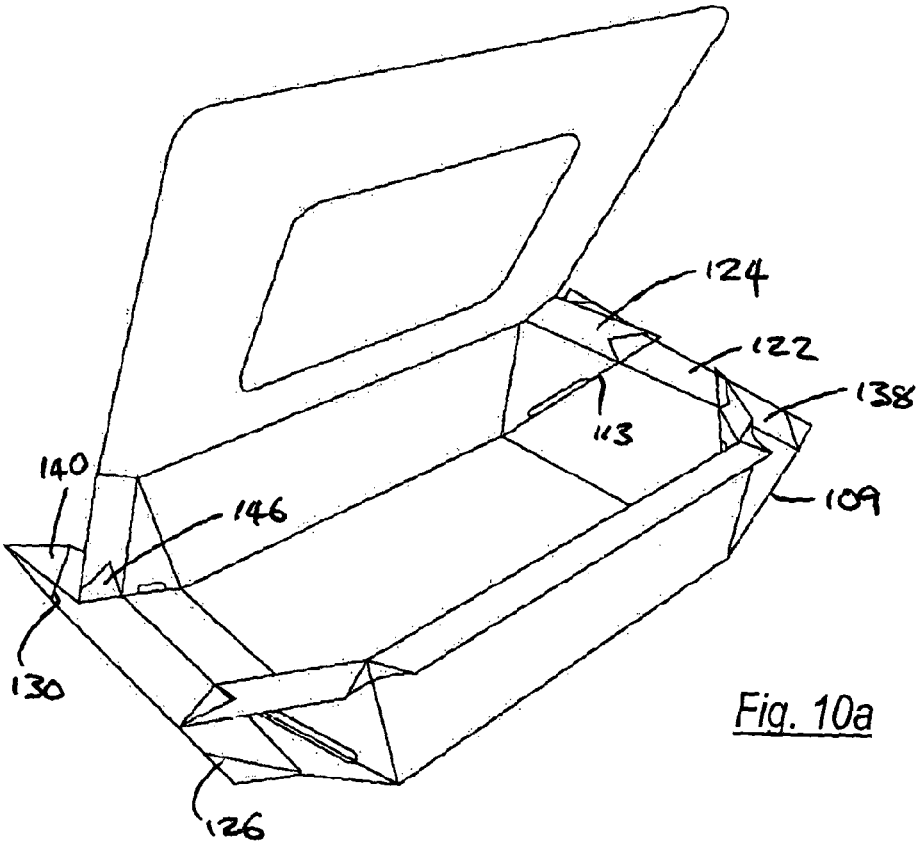
Figure 10B:
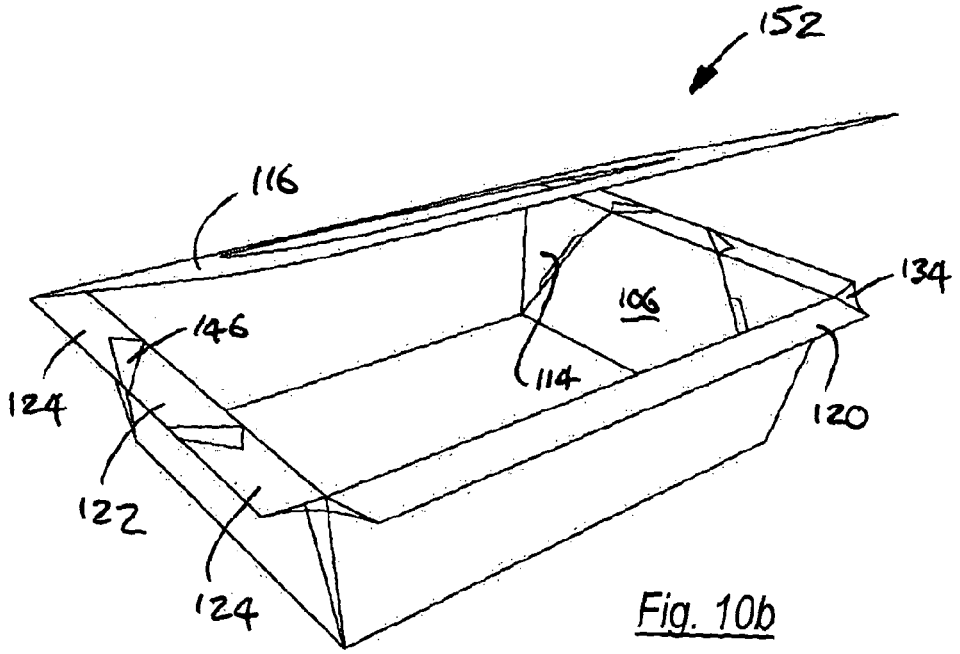
Figure 11A:
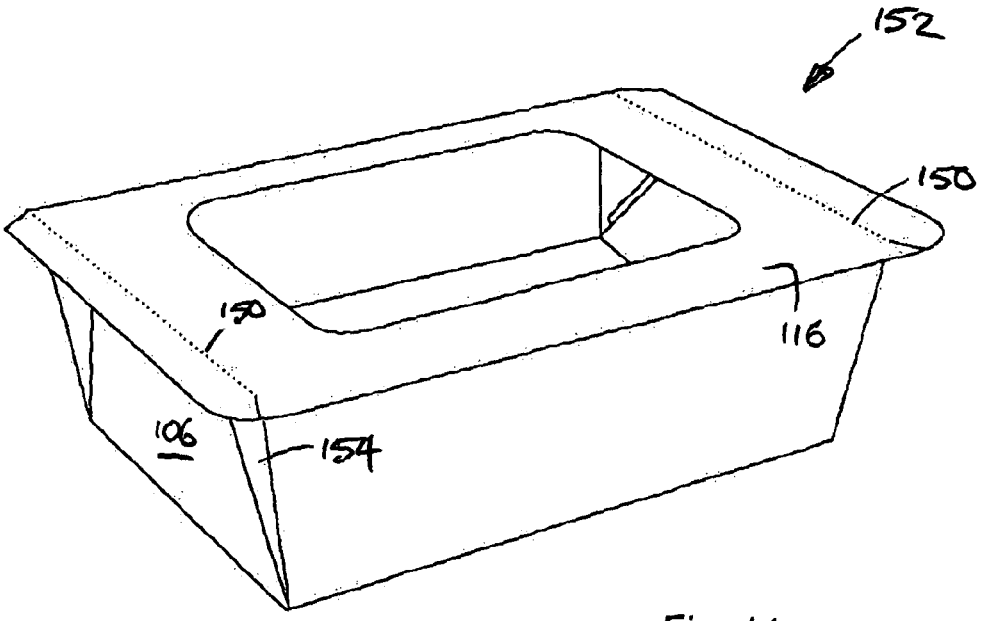
Figure 11B:
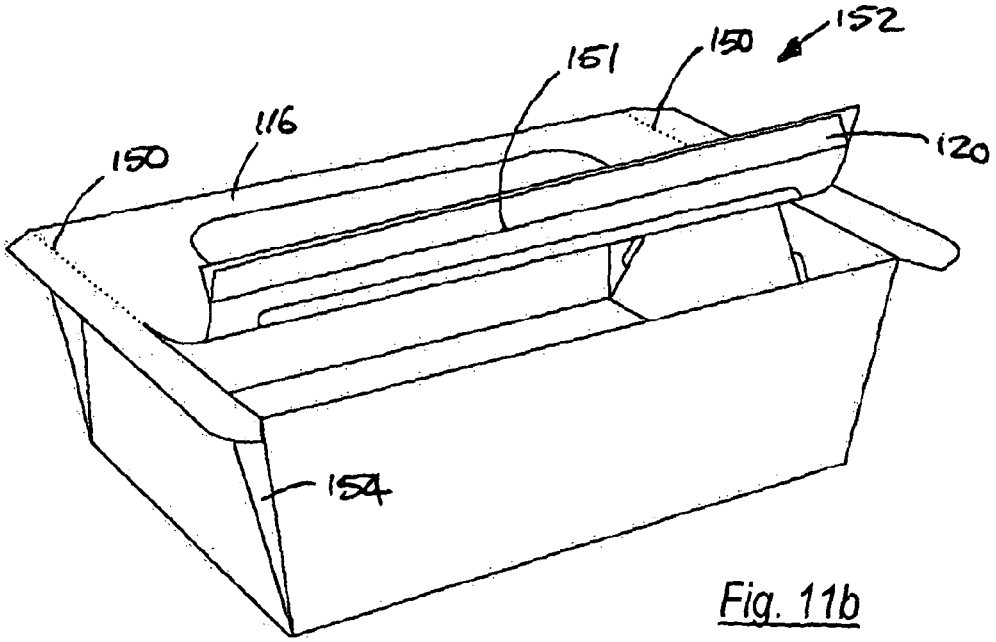

FIGS. 10*a* and 10*b* are perspective views showing the forming of a container from the folded blank of FIG. 9; and FIGS. 11*a* and 11*b* are perspective views showing an opening mechanism of the container A first preferred embodiment of the present invention is represented in accompanying FIGS. 1 to 7 as a generally rectangular container with an integral folding lid. The container is formed from a flat blank, comprising a paperboard layer and a laminated layer of liquid impermeable and heat sealable plastics film provided on one side of the paperboard layer.

Figure 1:
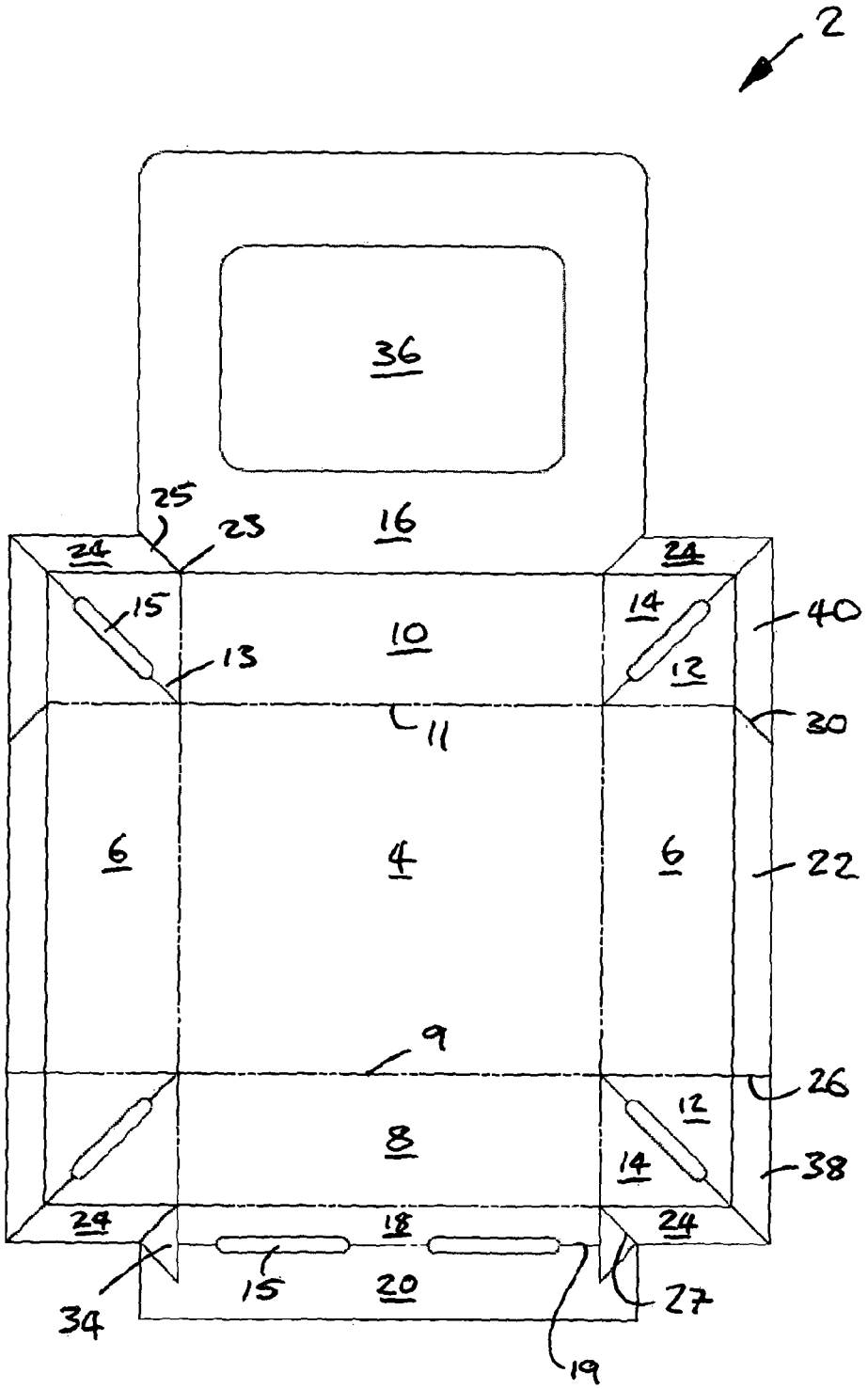
FIG. 1 is a plan view of a blank for forming a container according to a first embodiment of the present invention.

The initial blank 2 is shown in FIG. 1. The blank 2 consists of a number of panels defined by fold lines provided in the paperboard layer of the blank 2. A first, generally rectangular, panel will form the base of the container, and will thus be referred to as the base panel 4. Four further generally rectangular panels provided adjacent the four edges of the base panel will form the vertical walls of the container. For the sake of convenience, the two shorter walls of the container will be referred to as side walls 6, and the two longer walls will be referred to as the front wall 8 and the back wall 10.

At each of the four corners of the base panel 4, between each side wall 6 and the front and back walls 8,10 of the blank, are webbing panels. In each corner a first triangular webbing panel 12 is provided adjacent the side wall panel 6, and a second triangular webbing panel 14 is provided adjacent the front wall 8 or back wall 10 panel. The first and second webbing panels 12,14 at each corner together form a square webbing section, with a diagonal webbing fold line 13 between the first and second webbing panels 12,14 extending outwardly from the each corner of the base panel 4 at a 45° angle. Along the majority of each webbing fold line 13 a section of the paperboard is cutaway to leave voids 15 of only plastics film.

A side flange panel 22 is provided adjacent each side wall panel 6. Webbing flange panels 24 are also provided adjacent an edge of each second webbing panel 14. The width of the webbing flange panel 24 is the same as that of each side flange panel 22.

The integral lid is provided as a lid panel 16 adjacent the back wall panel 10. A front flange is provided adjacent the front wall panel 8. A fold line 19, aligned with the outer edges of the adjacent webbing flange panels 24 divides the front flange panel into first and second parts 18,20, with the first part 18 closest to the front wall 8. A pair of voids 15, similar to those provided along webbing fold lines 13, are provided along the fold line 19 in the front flange.

An inner edge of both side flange panels 22 is provided by a fold line extending the full length of the side wall 6 to which they are attached. A front edge 26 of each side flange panel 22 extends at a right angle to the length of the side flange panel 22 from the end of a fold line 9 provided across the entire width of the blank 2 between the base panel 4 and front wall panel 8 and between two of the first webbing panel 12 and the side wall panels 6. A rear edge 30 of each side flange panel 22 extends at a 45° angle to the length of the side flange panel 22 from the end of a further fold line 11 provided across the entire width of the blank 2 between the base panel 4 and rear wall panel 10 and between the other two of the first webbing panels 12 and the side wall panels 6. The outer edge of each side flange panel 22 is thus shorter than the inner edge.

Each webbing flange panel is in the shape of a parallelogram, with a first angled edge extending from, and following the line of, the webbing fold line 13 between the first and second webbing panels 12,14, and a second parallel angled edge 25,27 extending from a corner 21 of the front wall panel 8 or a corner 23 of the back wall panel 10. In the case of the webbing flange panels 24 nearest the back wall 10 of the blank, the second angled edge is defined by a fold line 25 between the webbing flange panel 24 and the lid panel 16. The remainder of the lid panel 16 is generally rectangular, and is larger in size than the base panel 4. A window 36 is provided in the lid panel.

The second angled edge 27 of each webbing flange panel 24 nearest the front wall 8 of the blank forms one edge of a triangular area where the paperboard is cutaway to leave an isosceles triangle of film 34. The triangular film area 34 has symmetry around fold line 19 between the first and second parts of the front flange 18,20, with the apex of the triangular film area 34 located at an outer edge of the webbing flange panel 24.

The blank 2 is formed using a known method where initial cuts and fold lines (creases or scores) are formed in a sheet of paperboard before a continuous film layer is laminated across the entire paperboard layer. A single continuous layer of heat sealable film is thus provided across the entire blank 2, and covers the cutaway sections described above to form the voids 15, window 36 and triangular film areas 34 without any discontinuities. The final shape of the blank is only cut after the film layer has been applied, so it, is possible to also provide additional areas of film at the edges of the paperboard layers. In the blank of FIG. 1, trapezoidal film areas 38,40 are provided between the first angled edge of each webbing flange panel 24 and the closest edge 26,30 of each side flange panel 22. A free edge of each trapezoidal film area 38,40 aligns with outer edge of each side flange panel 22.

One advantage of the blank 2 of FIG. 1 is that it can be partially formed but still left in a flat configuration for shipping. The initial forming steps are shown in FIGS. 2 and 3.

Figure 2:
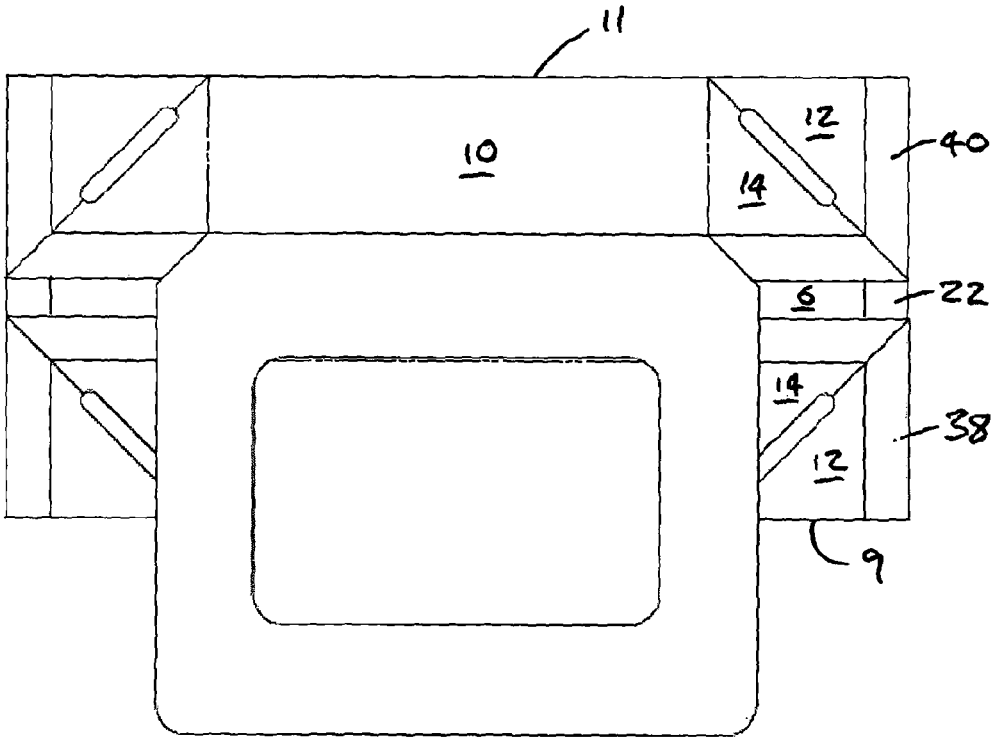
FIG. 2 is a plan view showing the blank of FIG. 1 being folded into a part formed configuration.

The blank 2 is positioned with the laminated film facing upwards, and is then folded at fold lines 9 and 11 into the configuration shown in FIG. 2. In this configuration, the trapezoidal film areas 38,40 can be seen to overlie the side flange panels 22 on both sides of the blank, and the webbing panels 12,14 overlie areas of the side wall panels 6. The first webbing panels 12 are bonded (glued or heat sealed) to the side wall panels 6, but no other parts of the container blank are bonded together at this stage.

Figure 3:
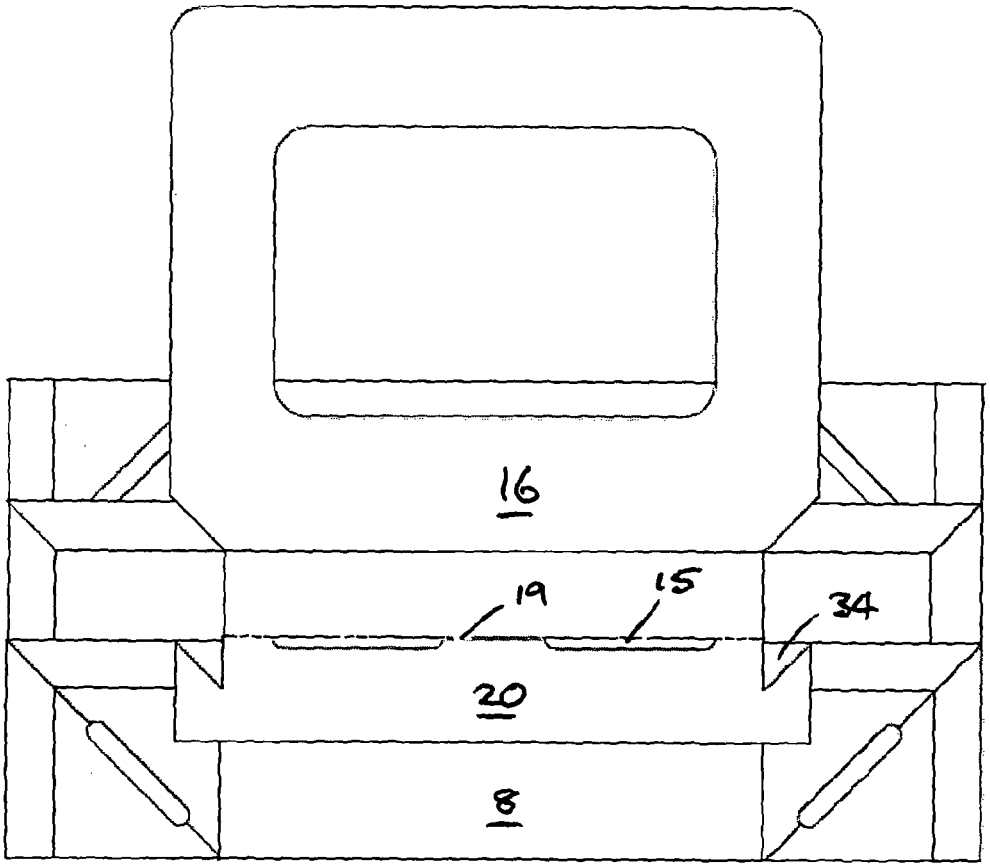
FIG. 3 is a further plan view showing the blank of FIG. 1 being folded into a part formed configuration.

The front flange panel is then folded at fold line 19, as shown in FIG. 3, so that the second part 20 of the front flange overlies the front wall panel 8. The lid pane 16 is shown folded back in FIG. 3 so that the folding arrangement of the front flange is visible. The triangular film areas 34 in the front flange are shown folded double at the fold line 19, as are the voids 15 located on fold line 19. The main purpose of the voids 15 on fold line 19 is to make folding of the blank 2 at fold line 19 easier.

The blank 2 can be shipped as folded and bonded as described above. The flat configuration allows the blank 2 to take up minimal space during transit.

The further forming of a container 52 from the blank 2 is shown in FIGS. 4 to 7.

Figure 4:
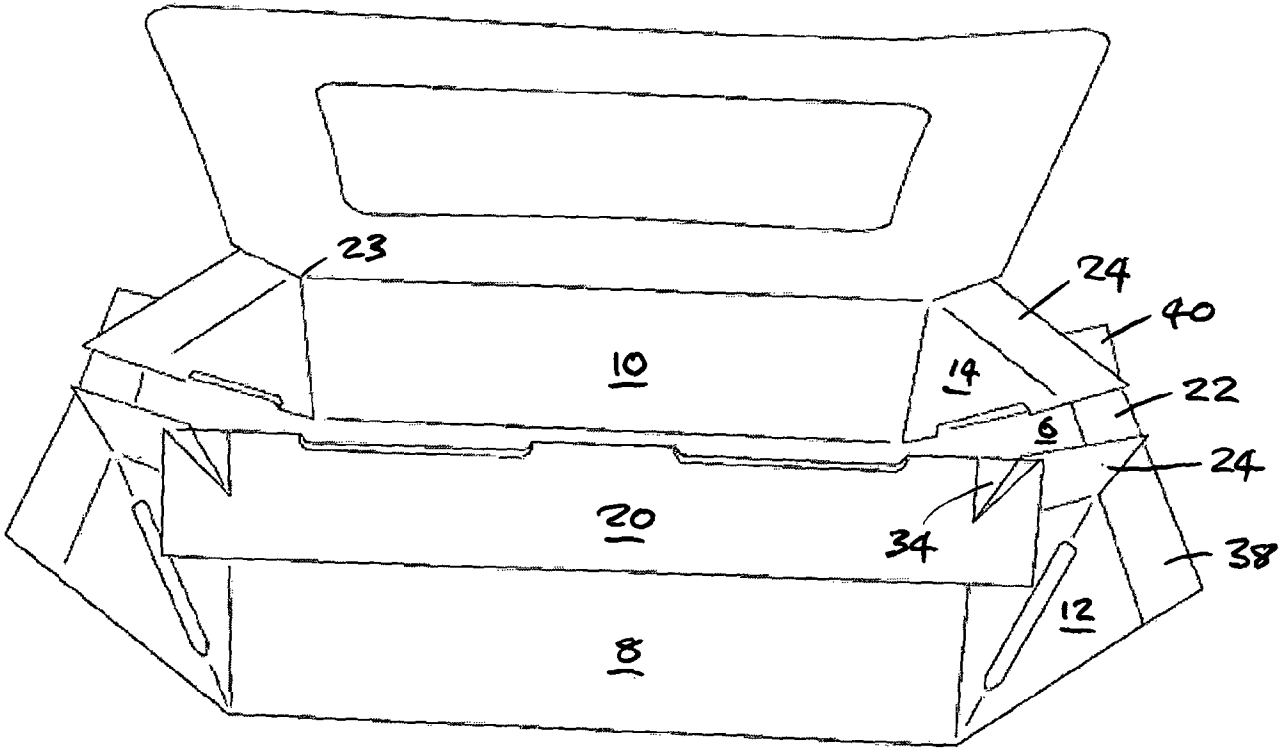
FIG. 4 is a perspective view showing the initial stages of forming of a container from the folded blank of FIG. 3.

FIG. 4 shows a front view of the part formed container blank 2 being assembled into a container. With the base panel 4 flat, the edges of side wall panels 6 are folded upwards. This movement of the side walls 6 causes each second webbing panel 14 (not bonded to the side walls) to fold relative to each first webbing panel 12 at the webbing fold lines 13, which in turn causes the front wall panel 8 and back wall panel 10 to fold upwards away from the base panel 4. The webbing fold lines 13 are easily folded because of the inclusion of voids 15. The side flange panels 22 are folded in the opposite direction to the side walls 6 to start forming an outwardly folded flange around what will be the container opening. The webbing flange panels 24 are folded outwardly in a similar way.

The angled fold lines 25 between the lid panel 16 and the adjacent webbing flange panels 24 allow lid panel 16 to fold inwardly so as to eventually cover the container opening as the webbing panels 24 are, folded outwardly. A similar folding arrangement occurs at the front of the container, where the first panel 18 of the front flange folds into the container opening as the adjacent webbing panels 24 are folded outwardly.

Figure 5:
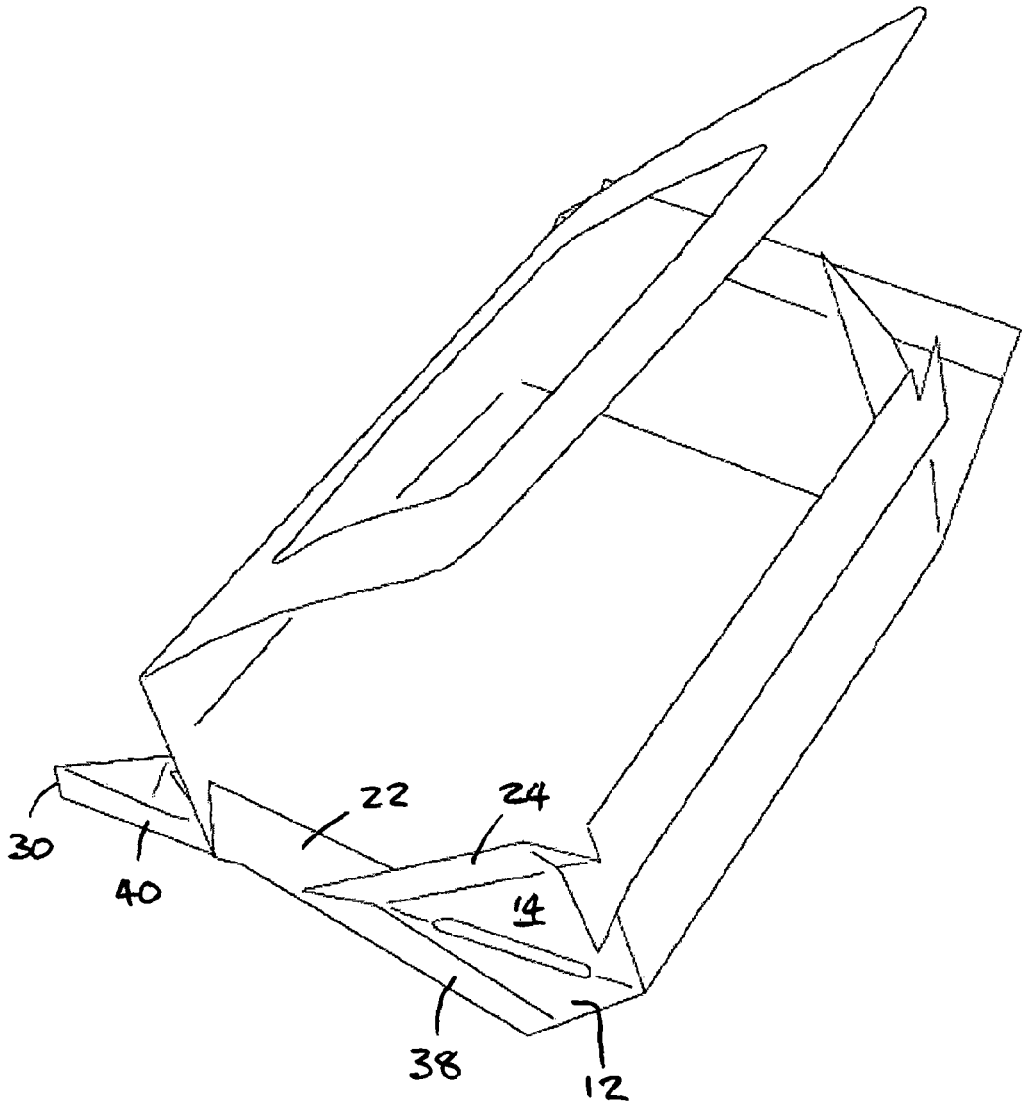
FIG. 5 is an alternative view showing the initial forming stages shown in FIG. 4.

The same folding operation is shown from a different angle in FIG. 5. It will be apparent that the trapezoidal film areas 38,40 will be sandwiched between the side flange panels 22 and webbing flange panels 24 as the second webbing panels 14 are folded onto the first webbing panels 12.

Continued folding of the side wall panels 6 causes the second webbing panels 14 to overlie the first webbing panels 12 against the inside surface of the side walls 6 of the container. The second part 20 of the front flange is folded outwardly at fold line 19 to provide an outwardly turned flange at the front of the container that has a width equal to that of the side flanges 22,24. A larger area for sealing the lid panel 16 can thus be provided by the second part 20 of the front flange without the front flange extending too far beyond the container walls. The angled rear edge 30 of each side flange panel 22 will also align with the angled fold line 25 between the lid panel 16 and each adjacent webbing flange panel 24.

Figure 6:
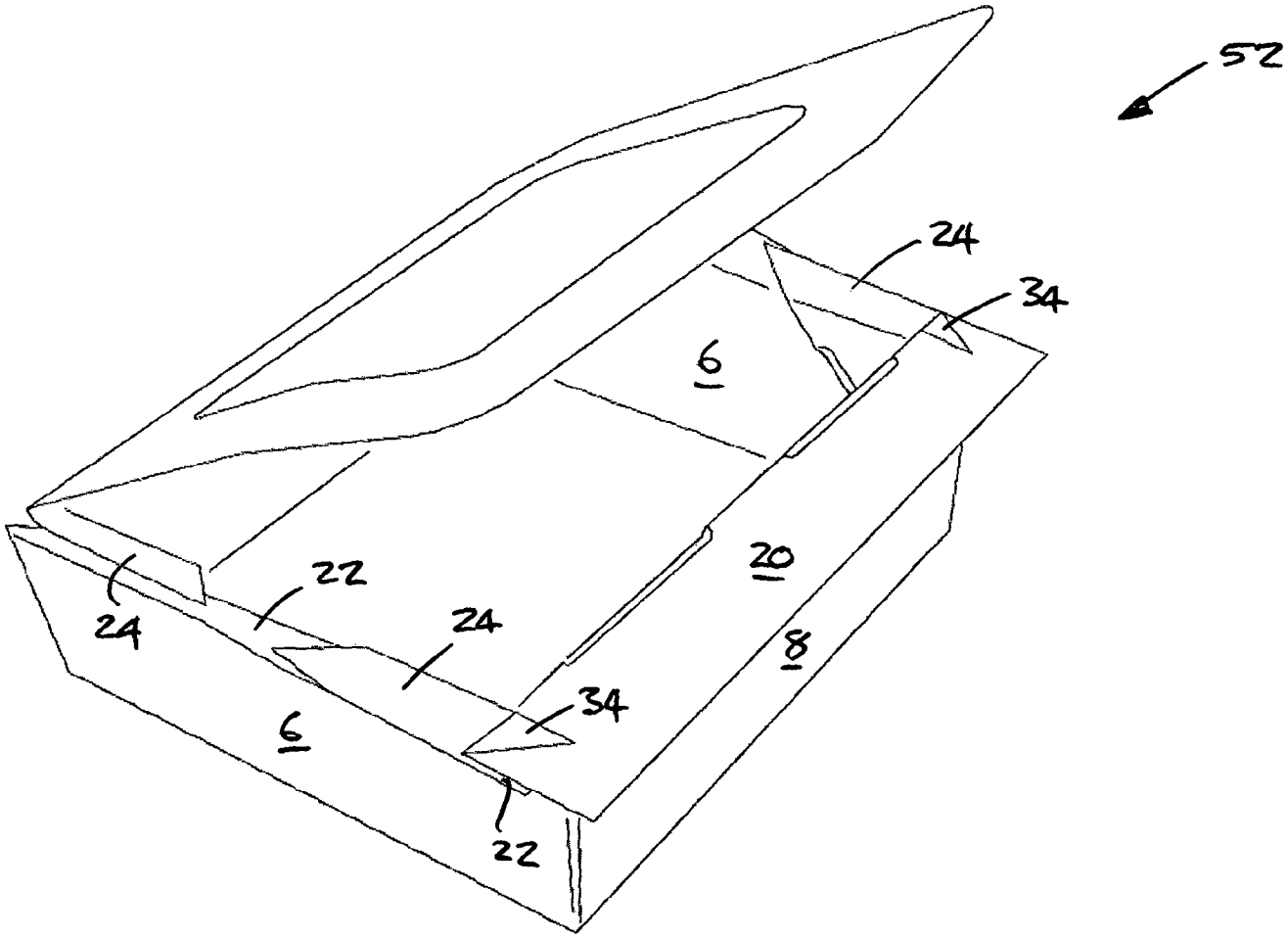
FIG. 6 is a perspective view of a container formed from the blank of FIG. 1.

FIG. 6 shows a container 52 formed from the blank ready for filling and sealing. Although not clearly visible in the Figure, it should be apparent that each of the trapezoidal film areas 38,40 is now sandwiched between a side flange panel 22 and a webbing flange panel 24. Because the first part 18 of the front flange is folded inwardly, the front flange overlies the ends of the side flanges 22. This helps to improve the seal at the corners of the container 52, and also provides some additional structural rigidity to the container 52. The area of paperboard removed from the front flange panels to form triangular film areas 34 accommodates the second angled edge 27 of the webbing flange panels 24 nearest the front of the container and avoids an undesirable build up of thickness of paperboard in these areas. The triangular film areas 34 themselves are folded in half to provide a double layer of folded film. The folding of the film triangles 34, along with the angled edge 27 provides a more tortuous route for any gas trying to enter or escape from the container than would be provided by straight seals or joins, thereby further improving the integrity of the container 52.

The corners 23 of the back wall 10 and the corners 21 of the front wall 8 now form the four corners of the container opening. Significantly, each one of the corners 21,23 is surrounded by further parts of the blank 2. The corners of a container opening, where the lid panel meets the container flange at two adjacent sides of the container opening, have traditionally been very difficult areas to seal effectively. In the present invention, there is no discontinuity in the material, in particular in the film layer, of the blank 2 at any of the corners 21,23. Indeed, the front flange overlies the corners 21 of the front wall 8 due to the inward folding of the first front flange part 18. This is of great assistance in providing a true hermetic seal so that vacuum packaging, gas flushing, or modified atmosphere packaging techniques can be employed to prolong the life of the container contents.

Rather than being further bonded before filling, the container 52 is simply held by the production tools in the erected configuration shown in FIG. 6 during the filling process. Once the container 52 has been filled, the lid panel 16 is closed and heat sealed to the flanges 20,22,24. The heat sealing process not only bonds the lid panel 16 to the exposed surface of the front flange 20, side flanges 22 and webbing flange panels 24, but also bonds the webbing flange panels 24 to the side flange panels via the trapezoidal film areas 38,40 sandwiched therebetween. This bonding is sufficient to give the pack structural stability without any further bonding process being necessary.

Moreover, it has been found that the body of the container 52 is capable of maintaining its erected form even after the lid panel 16 is subsequently opened. The lid panel can separate from the flange 20,22,24 of the container, but still leave the webbing flange panels 24 bonded to the side flange panels 22 to maintain the integrity of the container.

Figure 7:
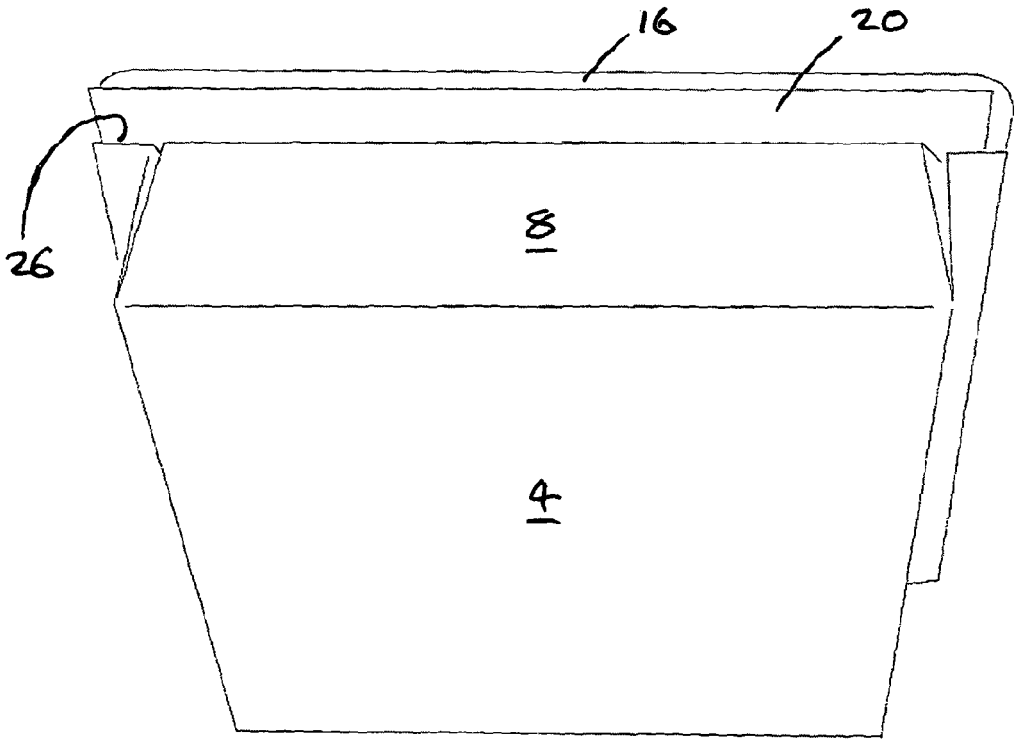
FIG. 7 is a view of the underside of the container from FIG. 6.

FIG. 7 shows a view from the underside of the container 52 of FIG. 6. It should be noted that there is no exposed plastics film on the underside of the flanges. When sealing the container 52, heat is applied to the top of the lid panel 16 and to the underside of the flanges 20,22,24. The paperboard layer protects the film from the direct application of heat which could damage the plastics material leading to a loss of integrity of the finished container 52.

Figure 8:
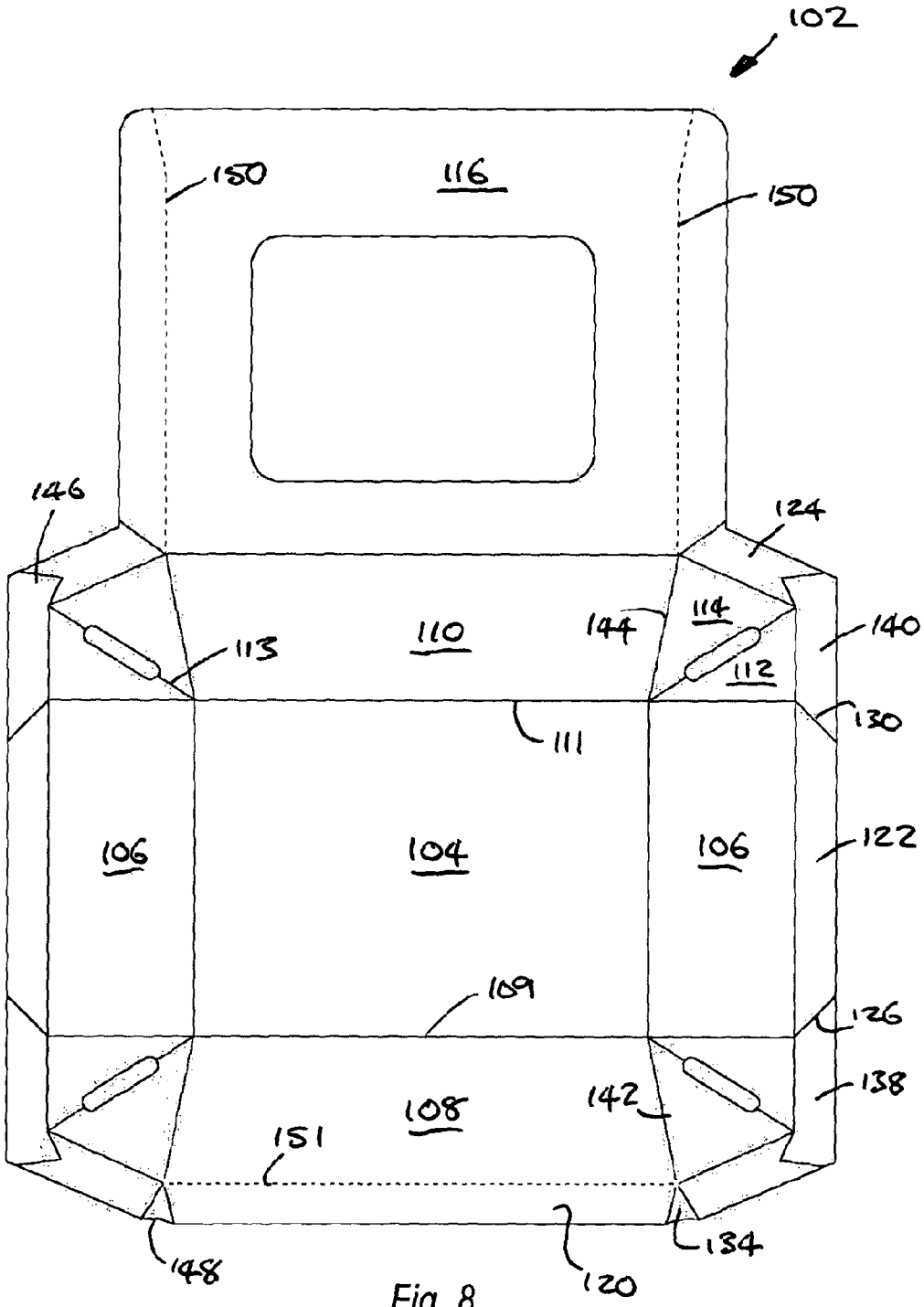
FIG. 8 is a plan view of a blank for forming a container according to a second embodiment of the present invention.

A second preferred embodiment of the present invention is shown in FIGS. 8 to 10. The blank 102 of the second embodiment is shown in FIG. 8, and has a number of similarities to the blank 2 of the first embodiment. The key differences will be described below.

Unlike in the blank 2 of FIG. 1, the panels forming the front wall 108 and back wall 110 of the second embodiment are not rectangular. Instead, the side edges 142,144 and each side of the front and back wall panels 108,110 are angled outwards away from the base panel 104 so as to provide a taper to the finished container. As shown in FIG. 8, the angle of the taper is 12° . The base panel 104 and side wall panels 106 remain rectangular, such that fold lines 109,111 running across the entire width of the blank 102 remain straight for their entire length to allow the blank 102 to be folded as described for the first, embodiment.

Another difference is that the fold lines 113 between the webbing panels 112,114 do not extend at 45° from each corner of the base 104. Instead, each fold line 113 is at 45° to the angled edges 142,144 of the front and back wall panels 108,110 so that the second triangular webbing panels 114 of the blank 102 of FIG. 8 are larger than the first triangular webbing panels 112. To ensure that the edges of the webbing panels 112,114 still align when the blank 102 is folded, the edges of the second triangular webbing panels 114 adjacent webbing flange panels 124 are angled relative to the fold lines 109,111 such that the webbing sections of the blank 102 of FIG. 8 are not square. The reason for these changes to the webbing will become clear when the folding of the blank is described.

The front edges 126 of the side flange panels 122, which were straight in the first embodiment, are angled at 45° towards the rear of the side flange panels 122, to mirror the angles of the rear edges 130 of the side flange panels 122. Cut-out sections 146 are also provided in the webbing flange panels 124 to enlarge the film areas 138,140.

The two-part front flange 18,20 of the first embodiment has been replaced by a simpler single front flange panel 120. The gap between each front flange panel 120 and the adjacent webbing flange panel 124 is spanned by a small triangle of film 134, the free edge 148 of which is cut in an inwardly extending arc.

The blank of FIG. 8 also shows a frangible opening mechanism for the container. The opening mechanism comprises a pair of tear lines 150 provided in the lid panel 116 and parallel to the side edges thereof, and a further tear line 151 between the front wall panel 108 and the front flange panel 120 of the blank 102.

The blank 102 of the second embodiment is folded in much the same way as the blank 2 of the first embodiment to form a container. FIG. 9 shows the blank 102, in the same configuration as FIG. 2, after the first stage of folding. The blank 102 has been folded at straight fold lines 109,111 such that the webbing panels 112,114 overlie the side wall panels 106. As with the first embodiment, only the first webbing panels 112 are glued, or otherwise bonded, to the side wall panels 106 at this time.

The simple construction of the blank 102 of FIG. 8 means that in the second embodiment all that is required to erect a container from the arrangement of FIG. 9 is to pull the front and rear wall panels 108,110 away from each other, or to fold the side wall panels 106 upwards towards each other. This action, as shown in FIG. 10*a*, automatically erects the walls of the container, and causes portions of the webbing flange panels 124 to overlap with the ends of the side flange panels 122. The angled ends 126,130 of the side flange panels 122 and the cut-out section 146 in the webbing flange panels 124 provide unsupported areas of film that fold during the process of erecting the container. The unsupported film easily follows the line of webbing fold lines 113 and fold lines 109,111 across the width of the blank 102 providing a zig-zag fold in film areas 138,140 within the container side flanges. The doubling back of the film in these zig-zag folds provides a more tortuous route for any gas trying to enter or escape from the container, thereby improving the container's integrity.

The final erected container 152 of the second embodiment is shown in FIG. 10*b*. The front flange panel 120 and the side flanges, formed of side flange panels 122 and webbing flange panels 124, have been folded out to provide a surface to which the lid panel 116 can be heat sealed to close the container 152. Double thickness areas of film resulting from the doubling back of film in cut-away areas 146 are provided on the upper surface of the side flanges to improve the bonding between the flanges and the lid panel 116.

FIG. 10*b* also shows how the triangles of film 134 between the front flange panel 120 and the adjacent webbing flange panels 124 have stretched to bridge the gaps in the flange of the finished container 152. The radius 148 provided in the free edge of each triangle of film 134 effectively lengthens the free edge and reduces the chances of the film splitting when stretched in forming the container 152, which is a common problem in designs of this type.

The two-part flange 18,20 in the first embodiment ensures that the film used to laminate the blank is not subjected to excessive stretching when forming a container from the blank 2. Through using a more advanced film, the degree of stretch/elongation possible before failure can be increased and so the blank 102 can be simplified. For the second embodiment, the blank 102 is laminated with a film comprising layers of Ethylene Vinyl Alcohol (EVOH) and Low Density Polyethylene (LDPE) providing superior characteristics (elongation at break and resistance to tear) to other films commonly used in the lamination of container blanks. One appropriate co-extruded film is available from French company Leygatech, and exhibits the following properties:

| | | |
|---|---|---|
| Stress at break (MD/TD): | 27/16 | Mpa |
| Elongation at break (MD/TD): | 410/470 | % |
| Resistance to tear (MD/TD): | 95/205 | $Nmm^{-1}$ |

The film also exhibits a water vapour transmission rate (at 38° C. and 90% relative humidity) of less than 7.5 $gm^{-2}/24$ h, and an oxygen permeability (at 23° C. and 0% relative humidity) of 2 $cm^3m^{-2}/24$ h or less. The film has a total thickness of 40 microns, made up of a 3 micron thick middle layer of EVOH sandwiched between two 18.5 micron thick layers of LDPE.

Another problem that exists with many films used in the lamination of container blanks is that they can become frazzled and loose integrity if exposed to high temperatures such as those employed during a heat sealing process. For this reason container blanks are often designed to ensure that no exposed plastics film is present on outer surfaces of the container that will be subject to heat sealing. Again, the use of more advanced film can overcome this problem such that the design of blanks can be further simplified. For example, in the second embodiment, the use of the more advanced film overcomes the problem that would otherwise arise from the presence of exposed film on the underside of the side flanges 122.

The container 152 is held together in its erected configuration by bonding the webbing flange panels 124 to the side flange panels 122, for example by heat sealing. This bonding step can be performed while the container 152 is in the configuration shown in FIG. 10*b*), or it can take place as part of the 'lidding' process, where the lid panel 116 is heat sealed to the container flanges as shown in FIG. 11*a*. It is not necessary to provide any additional bonding between the webbing panels 112,114 since the folding and bonding of the webbing flange panels 124 to the side flange panels 122 holds the second webbing panels 114 against the side walls 106 of the container. However, additional bonding may be included if desired.

The closed sealed container 152 shown in FIG. 11*a* provides a true hermetic seal so that vacuum packaging, gas flushing, or modified atmosphere packaging techniques can be employed to prolong the life of the container contents. The shape of the container blank 102 along with the film areas 134,138,140 and the zig-zag folds ion the film areas 138,140 between the side flange panels and the webbing panels all contribute to the hermetic seal achieved by the finished container.

An advantage of the second embodiment of the present invention is that a container 152 is provided which incorporates a taper in both its width and its length to simplify nesting and denesting of the finished container. As can be seen in FIGS. 11*a* and 11*b*, a triangular part 154 of the second webbing panel 114 extends beyond the edge of the rectangular side wall 106 to provide a taper to the sides of the finished container 152. In the illustrated embodiment, the taper provided by the triangular parts 154 is 12°, the same as the taper incorporated into the front and back walls 108,110 of the container 152. This results from the webbing fold lines 113 being maintained at 45° to the angled edges 142,144 of the front and back walls 108,110. By relying on the asymmetric folding of the webbing sections to provide a taper in the sides of the container 152, the fold lines 109,111 across the blank can remain straight and uninterrupted. This simplifies formation of the container.

Although it has been found that the strength of the bond between the webbing flange panels 124 and the side flange panels 122 is can survive removal of the container lid, the opening mechanism shown in FIG. 8 allows the container 152 to be opened while leaving portions of the lid panel 116 bonded to the side flanges of the container 152 to provide increased strength to the container 152 once opened. FIG. 11*a* again shows the tear lines 150 of the container opening mechanism, and the opening of the container 152 is illustrated in FIG. 11*b*. The front flange 120 is folded upwards and detached from the container body at tear line 151. The front flange 120 remains bonded to the lid panel 116 forming a tab which is held to tear open the container, while the lid panel 116 tears at tear lines 150 to leave the portions of the lid panel 116 located outside the tear lines 150 bonded to the side flanges of the container 152.

The invention is not considered to be limited to the specific examples described above. For example, the described blank has a generally rectangular base. The simplicity of this shape allows the blank to be cut with minimal waste from a larger piece of material, however the various features described above could also be applied to a number of other blank configurations if desired. The fold lines are described as being formed as scores or creases, but other suitable technique may be used as appropriate.

The invention claimed is:

1. A blank for forming a container with a container body and a flange section, at an edge of the container body, comprising two bonded overlapping flange panels, the blank comprising:

at least first and second wall panels which form the container body with a base and webbing sections between the first and second wall panels, wherein a first straight fold line extends across a width of the blank and permits the blank to be folded along the first straight fold line and causes the webbing sections to overlie areas of the first and second wall panels, the first straight fold line extending between the first wall panel and a base panel forming the base of the container, wherein a first of said overlapping flange panels extends from at least one of the webbing sections and a second of said overlapping flange panels extends from the first wall panel, the webbing sections being formed in two asymmetric parts with a second fold line therebetween configured to provide a taper in both a width and a length of the formed container.

2. The blank according to claim 1, wherein the webbing sections include areas of heat sealable film which are interposed between the first and second overlapping flange panels, wherein the heat sealable film bonds said first and second overlapping flange panels together and form a flange of the container.

3. The blank according to claim 2, wherein the areas of heat sealable film are located between ends of said first and second overlapping flange panels.

4. A blank according to claim 3, wherein said ends of said first and second overlapping flange panels are cutaway and enlarge the areas of heat sealable film.

5. The blank according to claim 1, wherein the first wall panel is rectangular.

6. The blank according to claim 5, wherein the base is rectangular.

7. A container formed from a folded blank, the container comprising:

a container body and a flange section, at an edge of the container body, comprising two bonded overlapping flange panels, wall panels which form the container body with webbing sections between the wall panels, the webbing sections being formed in two asymmetric parts with a fold line therebetween, wherein the webbing sections are folded together, with the fold line disposed in an interior of the container body, and a triangular part of one of the webbing sections being exteriorly disposed between the wall panels, wherein a first of said overlapping flange panels extends from each webbing section, and a second of said overlapping flange panels extends from at least one wall panel adjacent each webbing section, wherein said first and second overlapping flange panels are bonded together and maintain a shape of the container body, and wherein the first and second overlapping flange panels are bonded together when a lid is applied to the container.

8. The container according to claim 7, wherein the first and second overlapping flange panels are heat bonded together.

9. The container according to claim 7, wherein the webbing sections include areas of heat sealable film which are interposed between the first and second overlapping flange panels, and wherein the heat sealable film bonds said first and second overlapping flange panels together and form a flange of the container.

10. The container according to claim 9, wherein each layer of heat sealable film is folded back on itself at two locations by a folding of the blank and provide a zig-zag fold in the heat sealable film.

11. The container according to claim 7, wherein the first and second overlapping flange panels are bonded together by heat sealing of the lid to close the container.

12. The container according to claim 7, wherein the lid comprises one or more lines of weakness which provide a frangible opening for the container.

13. The container according to claim 7, wherein the container is hermetically sealed.

14. The container according to claim 7, wherein at least one of the wall panels is rectangular.

* * * * *